US005099879A

United States Patent [19]

Baird

[11] Patent Number: 5,099,879

[45] Date of Patent: Mar. 31, 1992

[54] COMBUSTION AIR FLOW STABILIZER

[75] Inventor: Raymond C. Baird, Santa Monica, Calif.

[73] Assignee: Coen Company, Inc., Burlingame, Calif.

[21] Appl. No.: 701,385

[22] Filed: May 16, 1991

[51] Int. Cl.[5] ..... F15D 1/02

[52] U.S. Cl. ..... 137/561 A; 138/37; 138/39

[58] Field of Search ..... 137/561 A, 573, 574; 138/37, 39

[56] References Cited

U.S. PATENT DOCUMENTS

| | | | |
|---|---|---|---|
| Re. 31,258 | 5/1983 | De Baun | 138/37 |
| 404,606 | 6/1889 | De Brower | 137/573 |
| 1,056,373 | 3/1913 | Segelken . | |
| 2,230,320 | 2/1941 | Cockrill | 138/37 |
| 2,580,706 | 1/1952 | Trisler | 138/37 |
| 3,134,655 | 5/1964 | Boucher | 138/37 |
| 3,191,630 | 6/1965 | Demyan | 138/42 |
| 3,840,051 | 10/1974 | Akashi et al. | 73/311 |
| 4,142,413 | 3/1979 | Bellinga | 138/37 |
| 4,154,265 | 5/1979 | Holsomback | 138/41 |
| 4,270,577 | 6/1981 | Brown et al. | 138/39 |
| 4,502,509 | 3/1985 | Spitz | 138/39 |
| 4,821,768 | 4/1989 | Lett | 138/39 |

*Primary Examiner*—A. Michael Chambers
*Attorney, Agent, or Firm*—Townsend & Townsend

[57] ABSTRACT

An air flow stabilizer having a pleated baffle system for attenuating turbulence and correcting non-uniform velocity distribution of gaseous flow through a flow conduit. The stabilizer is constructed from a plurality of baffle segments connected together in an accordion-like configuration edge to edge and angularly to one another. Each baffle segment has apertures to facilitate flow-through of gaseous flow parallel to and laterally across the axis of the flow stream. The baffle segments are secured to the flow conduit with support combs at the upstream end and the downstream end of the pleated baffle and reinforced by lateral stabilizing supports to provide a rigid structure.

9 Claims, 2 Drawing Sheets

COMBUSTION AIR FLOW STABILIZER

BACKGROUND OF THE INVENTION

In many industrial applications, air or gas flow through a conduit can become turbulent when objects or bends exist in the flow path. These objects or bends may be necessitated by physical dimensions of the application equipment or layout design constraints. The deflections caused by objects or bends in the flow path produce a non-uniform or asymmetrical flow velocity across the cross-section of the flow path. Bends or angles in the flow conduit as well as rotating propulsion equipment in the flow stream may cause additional turbulence in the form of vortices or swirls transverse to the flow path. Non-uniform distribution of gas, in conjunction with turbulence, is problematic in devices such as burners or apparatus requiring flow metering.

To attenuate or eliminate such turbulence, long and narrow straight flow channels are conventionally used to straighten the flow or create a more uniform flow distribution. To be effective, however, these channels require a large length-to-diameter (L/D) ratio. In some applications, a 30:1 L/D ratio or higher may be required. The use of such an elongated flow path may be impractical in many industrial applications where dimensional or physical constraints in the installation facilities make it impossible to incorporate long and straight channels. As a result, various diffuser or straightener structures have been used in the prior art to attenuate swirl or turbulence in an effort to provide a more uniform flow distribution. Honeycomb structures, for example, have been used as means to direct and straighten flow through a duct or channel. Honeycomb or like structures are inadequate in many applications, however, because they cannot attenuate asymmetrical flow turbulence unless each honeycomb segment has a large length-to-diameter ratio in itself. Additionally, many flow straightening structures create a significant resistance in the flow path thereby creating an excessive and undesirable pressure drop.

In addition to the above, many flow-straightening devices suffer from complexity of construction, making fabrication difficult and the resulting procurement cost undesirable.

SUMMARY OF THE INVENTION

The invention relates generally to a flow straightening device for stabilizing and smoothing gaseous flow through a defined channel. More specifically, the invention relates to a baffle system which attenuates turbulence and dampens pressure pulsation of gaseous flow in both directions through a channel to produce a more uniform, or straightened cross-sectional gaseous flow.

The invention is a flow stabilizer comprising an orificed pleated baffle system which attenuates turbulence and dampens pressure pulsation while allowing for lateral air movement across the baffle system thereby improving flow distribution. The baffle system is fabricated from a plurality of baffle segments connected in a pleated configuration forming converging baffle zones. The baffle system can be fabricated from a single piece of material but is preferably constructed from multiple baffle segments connected together. Each baffle segment has a plurality of apertures and is angularly positioned relative to the longitudinal axis of the flow conduit.

The angular positioning of the baffle segments is retained by at least one support comb at the upstream end and the downstream end of the baffle system which secure the connecting edges of adjacent baffle segments and fix the spacing at the pleats, or converging baffle zones, of the baffle system. Preferably, this pleated arrangement is further reinforced by lateral stabilizing supports disposed across the baffle system.

The baffle system is sized for the specific flow conduit application and is secured in the conduit such that the support combs lie upstream and downstream of the convergent-divergent baffle zones. As the air flow progresses upstream to downstream, the flow enters the converging baffle zones and is forced to flow through the apertures formed in the baffle segments as the zone converges. The flow can therefore travel laterally through the baffle system before exiting. As flow exits a converging baffle zone through the apertures, the flow passes through a diverging baffle zone before exiting. The diverging baffle zone is simply a converging baffle zone reversed. This reverse symmetry allows the stabilizer to attenuate turbulence and pulsations traveling upstream as well as downstream thereby providing maximum flow stabilization.

The baffle system has a plurality of apertures to allow flow-through. Each baffle segment forming the baffle system has apertures which are small relative to their spacing. The series of apertures located closest to the upstream lead edge of each baffle segment are made larger than the remaining apertures in each baffle segment to facilitate increased flow-through near the upstream end of the device and minimize pressure buildup. Because the full cross-section of the duct is filled with the baffle system, the air flow in the flow conduit must pass through these apertures to reach the downstream side of the conduit. As a result of this forced passage of air through the apertures, pressure gradients, turbulence, swirl and pulsations in the flow are attenuated.

The dimensions of the stabilizer are selected such that the device occupies the entire cross section of the particular flow conduit. The orificed or apertured baffle segments forming the pleated baffle system are each oriented at a slight oblique angle relative to the flow direction. The size of this angle is selected according to the particular application. The total area available for flow-through of gas through the baffle system, computed by adding the areas of all the individual apertures, can be made as large as desired depending on the particular application. For example, by using a large number of moderately sized apertures in each baffle segment, the total flow-through area available can be made significantly larger than the cross-sectional area of the air channel itself. This structure minimizes the flow resistance caused by the baffle system and provides a high superficial transparency factor. The baffle system's symmetry will also attenuate pulsations propagating in the reverse direction of gas flow, such as those created by rotating equipment in the flow stream downstream of the baffle system.

The stabilizer can be fabricated from low-cost and easy-to-manufacture materials. In the preferred embodiment, each baffle segment is formed of sheet steel and the apertures can be made by drilling or cutting at the selected locations. The baffle system is then made pleated by seal welding or stitch welding adjacent baffle segments together at their extreme ends into the pleated converging baffle zone structure and is laterally reinforced by lateral stabilizing supports across the baffle system. Support combs space and secure the upstream and downstream edges of the baffle segments in the desired configuration. The support combs also secure the baffle system to the particular flow conduit housing being used.

The resulting apparatus provides a simple, sturdy and effective flow stabilizing device which attenuates turbulence and pulsations in both directions of flow while being capable of economical fabrication. The device can be manufactured without sophisticated machinery or tooling by using conventional materials and construction methods.

DETAILED DESCRIPTION OF THE PREFERRED EMBODIMENT

Figure 1:
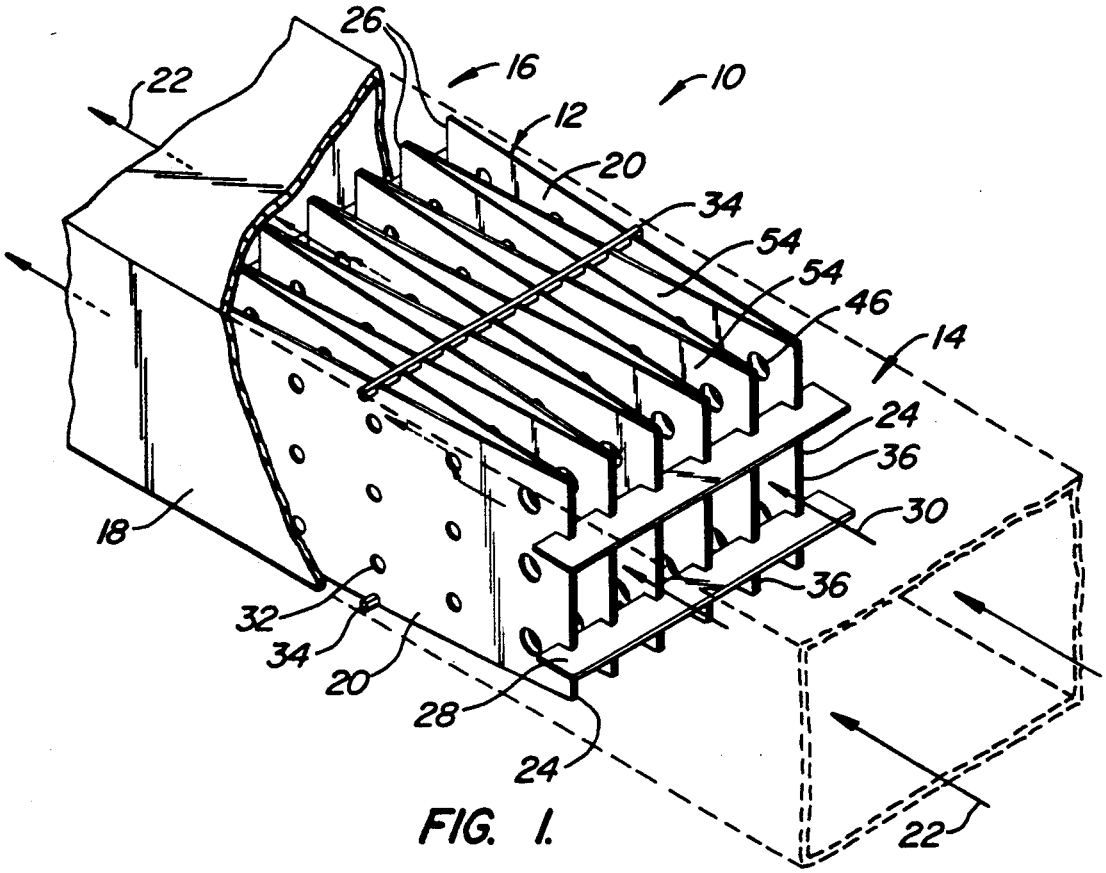
FIG. 1 is a prospective view of the invention disposed in a typical flow conduit, the flow conduit partially shown in broken lines.

Referring to FIG. 1, the invention is shown in the preferred embodiment. Stabilizer 10 is constructed with a pleated baffle system 12 having an upstream end 14 and a downstream end 16 and is shown disposed in a typical flow channel or duct work as represented by flow conduit 18. Baffle system 12 is composed of a plurality of baffle segments 20 arranged in a pleated configuration and connected together. Baffle segments 20 are each positioned at a slight, oblique angle relative to the longitudinal axis of flow direction 22 through flow conduit 18. The pleated configuration forms a series of lead edges 24 and trailing edges 26. Alternatively, pleated baffle system 12 can be constructed from a single sheet of material and bent into the pleated configuration, also providing lead edges 24 and trailing edges 26. Although the baffles illustrated in the drawing are shown as flat, each baffle segment 20 may be somewhat curved to facilitate assembly or increase rigidity.

The cross-section of baffle system 12 occupies the entire cross-section of flow conduit 18. As such, gaseous flow 30 entering stabilizer 10 from upstream end 14 is forced to flow through baffle system 12 to pass to the downstream end 16. Each baffle segment 20 is provided with a plurality of apertures 32 to facilitate gaseous flow both along the axis of the flow direction 22 and lateral to the axis of the flow direction 22. Lead edges 24 and trailing edges 26 forming the pleaded configuration are secured into position by support comb 28. The angular positioning of each baffle segment 20 in pleated baffle system 12 is further secured and reinforced by lateral stabilizing support 34. Preferably, one stabilizing support 34 is used across the top of pleated baffle system 12 and one across the bottom with large baffle systems, however, additional supports 34 at intermediate locations may be used for increased structural integrity.

Figure 2:
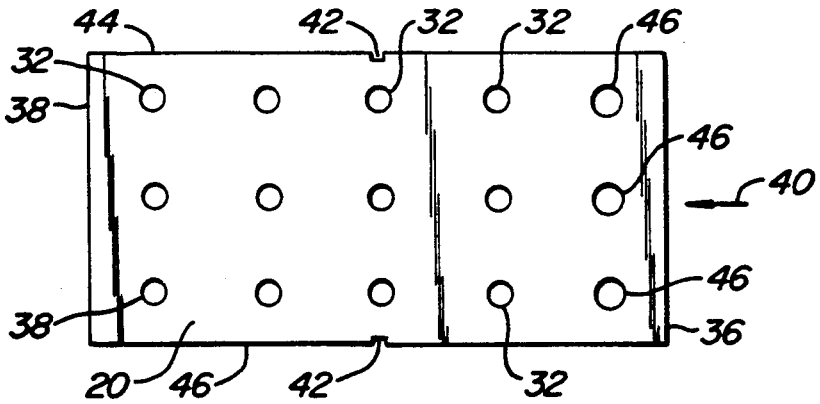
FIG. 2 is a front view of a single baffle segment used in the preferred embodiment of the invention, the baffle segment forming a part of the pleated baffle system and having a series of apertures with the apertures lying closest to the lead edge of the baffle segment made slightly larger than the remaining apertures.

In the preferred embodiment, baffle system 12 is fabricated from multiple independent baffle segments 20 interconnected at the appropriate angles. A single baffle segment 20 is shown in FIG. 2. Each baffle segment 20 has a upstream edge 36 and a downstream edge 38 defined relative to the primary direction of flow 40 through flow conduit 18. Baffle segment 20 includes a plurality of apertures 32 to facilitate gaseous flow through baffle segment 20. The number and size of apertures 32 used in each baffle segment 20 depends upon the characteristics of the flow being stabilized and the physical dimensions of flow conduit 18. Likewise, number of baffle segments 20 used to form baffle system 12 also depends upon these considerations. Preferably, the apertures 32 in baffle segment 20 are made circular to reduce corner effects potentially caused by square or angular orifices as well as to simplify fabrication.

Each baffle segment 20 can be cut from stainless steel sheets and apertures 32 can be formed by a punch press or other suitable means. Preferably, support notch 42 is included along top edge 44 and bottom edge 46 to provide a seat for lateral stabilizing support 34. Stabilizing support is welded or bonded to each baffle segment 20 at support notch 42 to provide rigidity.

Also in the preferred embodiment, at least two different sized apertures are incorporated into each baffle segment 20 as shown in FIG. 2. Apertures 46 located closest to upstream edge 36 are made of a larger dimension than those apertures 32 located downstream. These different sized apertures facilitate increased lateral flow through baffle system 12 at upstream edge 36. When these baffle segments 20 are joined together to form pleated baffle system 12 shown in FIG. 1, upstream edge 36 forms part of upstream end 14. Increased flow through large apertures 46 increases flow near upstream end 14 of baffle system 12 and thereby reduces pressure buildup by advantageously using the momentum of the flow upstream before pressure buildup occurs as flow travels into converging baffle zone 54.

Converging baffle zone 54 is formed from adjacent baffle segments 20 connected together at their downstream edge 36. Adjacent converging baffle zones 54 connect together at the lead edge 36 of baffle segments 20 to form the pleated configuration as shown in FIG. 1. The connection between converging baffle zones 54 at lead edge 36 also performs as a downstream edge of a converging baffle zone if viewed from the downstream end 14 of baffle system 12. The baffle configuration of stabilizer 10 is therefore inversely symmetrical except for aperture relationship. Stabilizer 10 could be installed in flow conduit 18 backwards with lead edges 24 pointing downstream without materially altering the performance.

Figure 3:
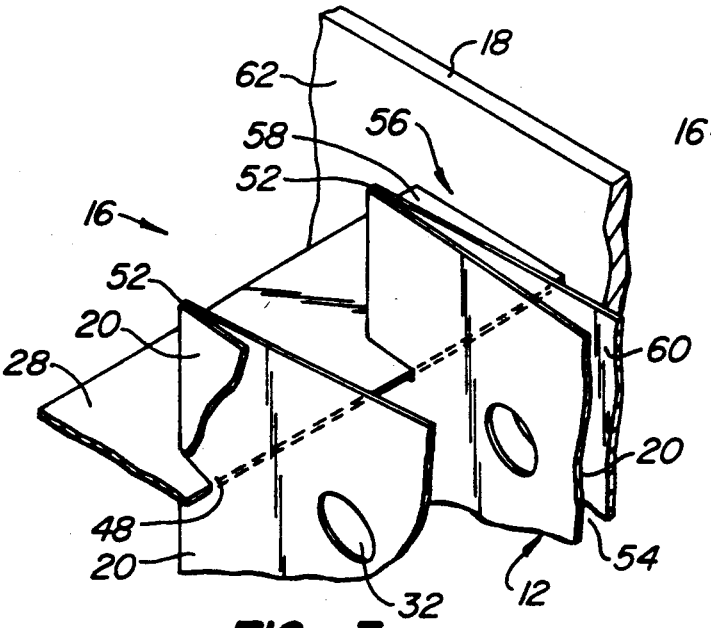
FIG. 3 is a partial prospective view of a support comb retaining baffle segments in the converging baffle zone configuration and showing a half baffle zone formed between the flow conduit wall and the end baffle segment where baffle comb terminates at the flow conduit.

Referring to FIG. 3, the side of pleated baffle system 12 is shown terminating at flow conduit 18. Downstream end 16 is illustrated in FIG. 3, but the following description applies equally to the upstream end 14 due to the symmetry in design. Pleated baffle system 12 terminates at each side with a half baffle zone 56 formed between the inside surface 62 and side baffle segment 60. Support comb 28 is fabricated from rigid material such as stainless steel or other suitable rigid material and secures pleated baffle system 12 to flow conduit 18. At least one support comb 28 is used at upstream end 14 and one at downstream end 16 of stabilizer 10 to support and secure pleated baffle system 12.

Figure 4:
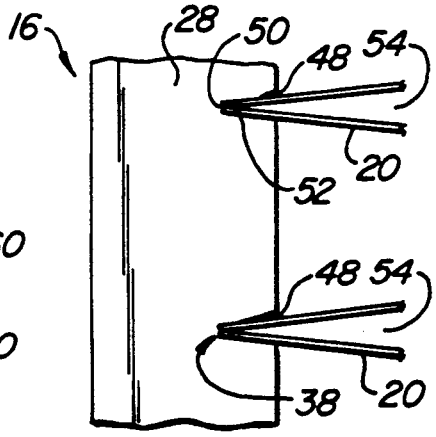
FIG. 4 is a partial top view of a support comb with channels retaining baffle segments in the converging baffle zone configuration with adjacent baffle segments connected together at a baffle mating junction.

Referring now to the detail shown in FIG. 4, support comb 28 includes spaced apart channels 48 for receiving trailing edge 38 (or the lead edge 36 if on the upstream end 16) of each baffle segment 20. Adjacent baffle segments 20 are welded together in the preferred embodiment to provide a sealed seam 50 at baffle segment mating junction 52. Seam 50 prevents leakage at mating junction 52 and inhibits vibration.

As previously described in FIG. 1, the angular positioning of adjacent baffle segments 20 forms converging baffle zone 54 between adjacent baffle segments 20. The cross section of converging baffle zone 54 diminishes in size down to baffle segment mating junction 52. Due to the pleated configuration of baffle system 12, the location of baffle segment mating junction 52 alternates from upstream to downstream as the zigzag structure of adjoining baffle segments 20 connect together to fill the lateral dimension or cross-sectional space of flow conduit 18.

The number of channels 48 in support comb 28 corresponds to the number of baffle segment mating junctions 52 at either end of pleated baffle system 12. Each mating junction 52 is positioned inside a channel 48 of support comb 28 and is secured therein by welding or other appropriate means. As a result, adjacent baffle segment mating junctions 52 are spaced apart at the desired dimension by support comb 28 and held firmly in place. Half baffle zone 56 is used at the outside end 58 of support comb 28 where a single side baffle segment 60 mates with the inside surface 62 of flow conduit 18. Preferably, this junction is also welded to prevent vibration and reduce leakage. Suitable welding techniques can also be used to create an air-tight seam where side baffle segment 60 connects with inside surface 62 of flow conduit 18 but is not necessary to practice the invention.

Support comb 28 is preferably coupled to inside surface 62 of flow conduit 18 by welding or appropriate means to position and secure anchor stabilizer 10 where desired and increase overall rigidity.

During installation of stabilizer 10 in flow conduit 18, it is desireable to take precautions in order to reduce intermediate leakage through stabilizer 10. Intermediate leakage includes all flow leakage through stabilizer 10 which does not flow through apertures 32 such as leakage around the perimeter of stabilizer or at mating junctions 52 where baffle segments 20 mate together. Careful attention to dimensional tolerances can reduce or eliminate perimeter intermediate leakage. Alternatively, an airtight seam can be formed along the perimeter of the interface between stabilizer 10 and flow conduit 18. Seam 50 formed at each baffle segment mating junction 52 reduces or eliminates intermediate flow leakage between adjacent baffle segments 20 as well as adding to overall rigidity. Suitable seams can also be made at the appropriate locations along the top and bottom surface of stabilizer 10 to completely eliminate any and all leakage through stabilizer 10 in flow conduit 18.

Figure 5:
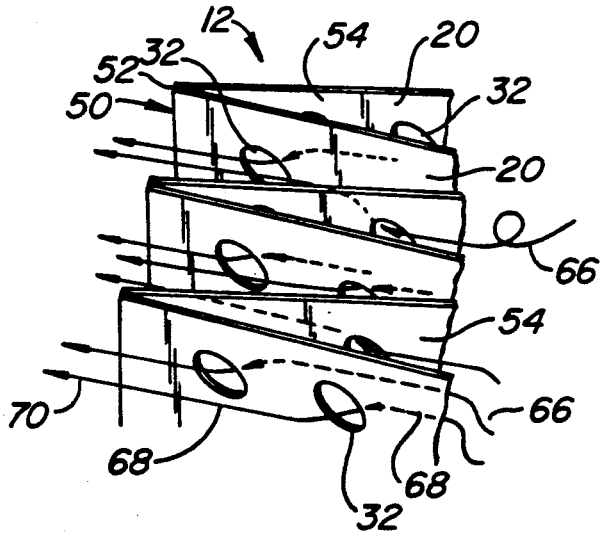
FIG. 5 is partial prospective view of the downstream edges of the pleated baffle system showing typical flow travel upstream to downstream through the apertures located in the baffle segments.

When stabilizer 10 is properly installed in flow conduit 18, pleated baffle system 12 effectively attenuates swirl or other turbulence as well as non-uniform flow velocities in the gaseous flow. As best appreciated from FIG. 5, entering flow stream 66 enters stabilizer 10 by travelling between lead edges 24 formed by mating baffle segments 20 and into a converging baffle zone 54. As gas flows downstream, the cross-sectional area of converging baffle zone 54 diminishes, flow 68 is forced to travel laterally through apertures 32 within baffle system 12. As a result, turbulence or vortices within the entering turbulent flow 66 are diverted and attenuated. Pleated baffle system 12 acts to filter the turbulent flow 66 and redistribute it laterally such that existing flow 70 becomes straightened and more uniform.

The number and dimension of apertures 32 is selected to counteract the resistance to flow caused by the physical surface area of stabilizer 10. Pressure loss is a function of the turbulence, rotational flow, and velocity profile of the entering flow 66. Larger apertures 46 positioned near the upstream end of baffle system 12 promote increased lateral flow near the upstream end to account for the momentum of flow and to reduce pressure buildup at the downstream end and thereby minimize pressure loss. The spacing and number of apertures 32 in each baffle segment 20 is selected to maximize the flow straightening characteristics of stabilizer 10 while minimizing pressure drop. A superficial transparency factor greater than 75% can be achieved when the apertures are correctly utilized.

In a typical industrial burner application having a flow conduit with a 12" height and a 18" width, an approximate 65% superficial transparency factor can be obtained with a pleated baffle system 12 constructed with twelve baffle segments 20, each with a 12" height and 24" length. Each baffle segment 20 would be positioned at an angle of between approximately 3.0 to 4.0 degrees relative to the longitudinal axis of flow, with the angle between adjacent baffle segments approximately 6.0 to 8.0 degrees. The angle between adjacent baffle segment 20 can be varied, however, across the width of pleated baffle system 12 if desired to accommodate a particular flow pattern. Each baffle segment 20 would preferably be drilled with fifteen orifices as shown in FIG. 2. Large apertures 46 could be approximately $1\frac{3}{8}$" diameter and the remaining apertures 32 could be of the order of $\frac{7}{8}$" diameter.

The number and size of baffle segments 20 and the number and size of apertures can be varied in accordance with the particular application. To minimize flow resistance, the superficial transparency should be maximized while avoiding the creation of a sieve which would provide insufficient attenuation of turbulence. The actual dimensions must be computed according to the particular flow velocity and flow characteristics in the particular application. In the preferred embodiment of the invention, the length of each baffle segment 20, the number and size of apertures 32 as well as the number of baffle segments 20 are all considered to provide stabilizer 10 with an effective length over width (L/D) ratio of approximately 16:1. Stabilizer 10, however, will provide effective straightening characteristics with L/D ratios anywhere in the range of 3:1 to 20:1 for a typical burner flow conduit applications.

Figure 6:
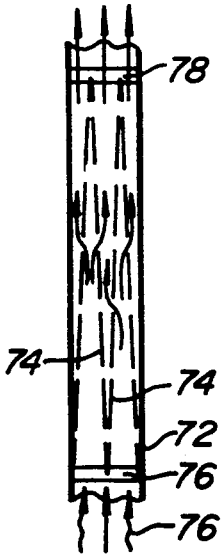
FIG. 6 is a top view of the invention disposed in a long, narrow flow conduit using four baffle segments configured to form the pleated baffle system.
Figure 7:
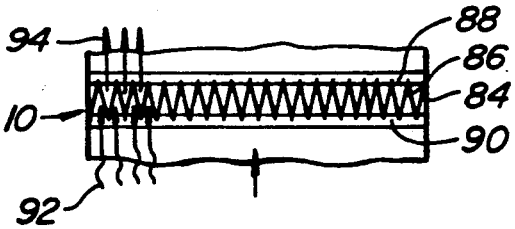
FIG. 7 is a top view of the invention disposed in a wide, short flow conduit incorporating a large number of short baffle segments configured to form the pleated baffle system.

The dimensional characteristics of stabilizer 10 can also vary widely with the particular applications contemplated. FIG. 6 shows a long and narrow flow conduit 72. A small number of baffle segments 74, shown as broken lines in FIG. 6, supported by support combs 76, 78 could be used to effectively straighten the flow path 76 in such a configuration. The invention could even be practiced using only two extremely long baffle segments 20 creating a tent baffle. In contrast, a short and wide flow conduit 84 as shown in FIG. 7 would necessitate a large number of short baffle segments 86 supported by support combs 88, 90. Entering turbulent flow 92 straightens as it passes through stabilizer 10 and passes downstream as exit flow 94 in a more uniform straightened flow path.

The relative symmetry of stabilizer 10 also effectively attenuates reverse flow turbulence or pulsations created by rotating propulsion equipment such as fan blades and the like which would otherwise propagate upstream in the gaseous flow path.

The construction of stabilizer 10, as described by the foregoing, is simple but provides dramatic results. The foregoing description of the preferred embodiments of the invention have been presented for purposes of illustration and description. It is not intended to be exhaustive or to limit the invention to the precise form disclosed, and obviously many modifications and variations are possible in light of the above teaching. For example, stabilizer 10 can be formed from alloys, ceramics, or any suitable material which is appropriate for the flow velocities and temperatures of the particular application. In addition, bonding techniques other than welding could be used to prevent intermediate leakage at the relevant junctions. Apertures 32 could be made of oval, trapezoidal, hexagonal, or any other shape without diverging from the spirit and scope of the invention. Further, the concept of the invention could be employed by using a generally spherical shaped stabilizer 10 in a flow conduit having other than a rectangular cross-section.

The embodiments chosen and described in this description were selected to best explain the principles of the invention and its practical application to thereby enable others skilled in the art to best utilize the invention in various embodiments and with various modifications as are suited to the particular application contemplated. It is intended that the scope of the invention be defined by the claims appended hereto.

What is claimed is:

1. A flow stabilizer for attenuating turbulence in gaseous flow through a flow conduit, comprising:

a pleated baffle system having at least two baffle segments, said baffle segments having an upstream edge, a downstream edge, a front face, a back face, and a plurality of apertures to allow gaseous flow-through laterally across the baffle system from the back face to the front face, said baffle segment each positioned at an acute angle relative to the longitudinal axis of the flow conduit and connected to an adjacent baffle segment at either the upstream edge or the downstream edge; and a support comb connected to the pleated baffle and spacing said baffle segments in their angular configuration.

2. The flow stabilizer of claim 1, wherein said support comb further secures the pleated baffle to said flow conduit.

3. The flow stabilizer of claim 1, wherein said first aperture and said second aperture are made substantially circular.

4. The flow stabilizer of claim 2, wherein said baffle segments each have at least one first aperture of a first dimensional area and at least one second aperture of a second dimensional area, said first dimensional area being larger than said second dimensional area, and wherein the first aperture is positioned substantially near said upstream edge of said baffle segment.

5. The flow stabilizer of claim 3, wherein said first aperture and said second aperture are made substantially circular.

6. The flow stabilizer of claim 4, further comprising at least one lateral stabilizing support extending transversely across said baffle system, said baffle segment having a notch for receiving the lateral stabilizing support, said lateral stabilizing support mated to said baffle segment at said notch.

7. A flow stabilizer for attenuating turbulence in gaseous flow through a flow conduit, comprising:

a longitudinal axis disposed substantially parallel to the longitudinal axis of the flow conduit;

a pleated baffle system having at least one converging baffle zone, the converging baffle zone bordered by a first baffle segment and a second baffle segment, said first baffle segment and said second baffle segment each positioned at an acute angle relative to the longitudinal axis of said flow conduit forming a first lead edge and a second lead edge and positioned such that the lateral distance between the first baffle segment and the second baffle segment decreases along the longitudinal axis from the first and second lead edges positioned upstream to a trailing edge located downstream where the first baffle segment and the second baffle segment connect;

a plurality of apertures distributed across said pleated baffle system to allow gaseous flow to travel through said pleated baffle system laterally across the longitudinal axis of said baffle system, the first baffle segment and the second baffle segment each having at least one first aperture of a first dimensional area and at least one second aperture of a second dimensional area, said first dimensional area being larger than said second dimensional area, the first aperture positioned substantially near the lead edge of the first baffle segment or the second baffle segment; and means for securing said pleated baffle within the flow conduit.

8. The flow stabilizer of claim 7, wherein said first aperture and said second aperture are made substantially circular.

9. The flow stabilizer of claim 8, further comprising at least one lateral stabilizing support extending transversely across said baffle system, said converging baffle zone including a notch for receiving the lateral stabilizing support, said lateral stabilizing support mated to said converging baffle zone at said notch.

* * * * *